US011547878B2

(12) United States Patent
Baker et al.

(10) Patent No.: US 11,547,878 B2
(45) Date of Patent: Jan. 10, 2023

(54) RESPIRATORS

(71) Applicant: Core Protection Systems Ltd., Haydock (GB)

(72) Inventors: Troy Baker, Denbighshire (GB); Graham Wilson, Denbighshire (GB)

(73) Assignee: Core Protection Systems Ltd., Haydock (GB)

( * ) Notice: Subject to any disclaimer, the term of this patent is extended or adjusted under 35 U.S.C. 154(b) by 170 days.

(21) Appl. No.: 15/038,947

(22) PCT Filed: Nov. 28, 2014

(86) PCT No.: PCT/GB2014/053528
§ 371 (c)(1),
(2) Date: May 24, 2016

(87) PCT Pub. No.: WO2015/082883
PCT Pub. Date: Jun. 11, 2015

(65) Prior Publication Data

US 2017/0021203 A1 Jan. 26, 2017

(30) Foreign Application Priority Data

Dec. 4, 2013 (GB) ..... 1321369

(51) Int. Cl.
*A62B 7/00* (2006.01)
*A62B 7/10* (2006.01)
(Continued)

(52) U.S. Cl.
CPC ..... *A62B 7/10* (2013.01); *A62B 7/12* (2013.01); *A62B 9/02* (2013.01); *A62B 9/04* (2013.01);
(Continued)

(58) Field of Classification Search
CPC ..... A62B 18/02; A62B 18/025; A62B 18/084; A62B 9/04
See application file for complete search history.

(56) References Cited

U.S. PATENT DOCUMENTS 2,381,568 A 8/1945 Booharin et al.
4,276,877 A 7/1981 Gdulla
(Continued)

FOREIGN PATENT DOCUMENTS

EP 0511592 A1 11/1992
GB 222366 A 10/1924
(Continued)

OTHER PUBLICATIONS

U.K. Search Report dated Jan. 2, 2014 for U.K. Application No. GB 1321369.9 filed Dec. 4, 2013.
(Continued)

*Primary Examiner* — LaToya M Louis
(74) *Attorney, Agent, or Firm* — Morgan, Lewis & Bockius LLP

(57) ABSTRACT

A respirator (10) having an oral-nasal unit (12) with a peripheral seal that seals around the nose and mouth of a wearer's face and having an inlet aperture (40) connectable to a supply of breathable air, and an outlet aperture (42). The unit having a rigid insert (106) with an exterior profile adapted to seat against a correspondingly shaped interior surface of the unit (12); an outlet conduit (112) with a tube adapted to extend through the exhale aperture (40) of the unit (12); and a wing portion (110) with a through aperture (122) registering with the unit's inlet aperture (40). The outlet conduit (112) having a bayonet connector (130, 132) that enables the unit to interchangeably and detachably connect to, a connector formed as part of an exhale aperture
(Continued)

of a full-face mask, or of a harness assembly (102). The bayonet connector forms an airtight seal between the two.

16 Claims, 5 Drawing Sheets

(51) Int. Cl.

| | |
|---|---|
| ***A62B 9/04*** | (2006.01) |
| ***A62B 18/02*** | (2006.01) |
| ***A62B 19/00*** | (2006.01) |
| ***A62B 7/12*** | (2006.01) |
| ***A62B 9/02*** | (2006.01) |
| ***A62B 18/08*** | (2006.01) |

(52) U.S. Cl.
CPC ..... *A62B 18/02* (2013.01); *A62B 18/025* (2013.01); *A62B 18/084* (2013.01); *A62B 19/00* (2013.01)

(56) References Cited

U.S. PATENT DOCUMENTS

| | | | | |
|---|---|---|---|---|
| 4,574,799 | A | 3/1986 | Warncke | |
| 5,062,421 | A | 11/1991 | Burns et al. | |
| 5,924,420 | A | 7/1999 | Reischel et al. | |
| 6,016,804 | A | 1/2000 | Gleason et al. | |
| 6,761,169 | B2 * | 7/2004 | Eswarappa | A62B 7/10 128/205.27 |
| 2003/0217752 | A1 | 11/2003 | Muller et al. | |
| 2004/0226563 | A1 | 11/2004 | Xu et al. | |
| 2005/0145249 | A1 | 7/2005 | Solyntjes et al. | |
| 2006/0090754 | A1 | 5/2006 | Mittelstadt et al. | |
| 2007/0212921 | A1 | 9/2007 | Maschler | |
| 2009/0272378 | A1 | 11/2009 | Betz et al. | |
| 2015/0202473 | A1 * | 7/2015 | Curran | A62B 18/006 128/202.27 |

FOREIGN PATENT DOCUMENTS

| | | | |
|---|---|---|---|
| GB | 1587812 | A | 4/1981 |
| GB | 2173109 | A | 10/1986 |
| WO | 02/13946 | A2 | 2/2002 |
| WO | 0211816 | A1 | 2/2002 |
| WO | 0213946 | A2 | 2/2002 |
| WO | 02/092170 | A2 | 11/2002 |
| WO | 02092170 | A2 | 11/2002 |
| WO | 2005089876 | A1 | 9/2005 |
| WO | 2007106809 | A2 | 9/2007 |
| WO | 2009029364 | A1 | 3/2009 |
| WO | 2009066833 | A1 | 5/2009 |
| WO | 2013019764 | A2 | 2/2013 |

OTHER PUBLICATIONS

U.K. Search Report dated Jul. 11, 2014 for U.K. Application No. 1411885.5 filed Jul. 3, 2014.
International Search Report dated Mar. 18, 2015 for International Application No. PCT/GB2014/053527 filed Nov. 28, 2014.

* cited by examiner 72
136
128
A
140

14
40
128
106
110
72
110
122
108
122
116
130
112
118
114
132

72
B
128
A
138
140

112
130
116
106
118
118
110
114
132
122
108

130
114
C
B
118
112
C
132

RESPIRATORS

This invention relates to respirators.

Respirators are items of Personal Protective Equipment (PPE) that a user wears to filter-out airborne contaminants in the air that they breathe. So-called passive respirators have an in-line filter through which inspired air passes before entering the user's nose and/or mouth. Other types of respirator exist, such as bottled air respirators whereby a supply of clean, bottled air is connected to a respirator unit worn by the user such that the user only breathes-in the bottled air, rather than filtered ambient air. Further types of respirators can combine these technologies and/or comprise a breathing apparatus that actively scrubs ambient air and/or mixes it with bottled air, so that the user only inhales safe air.

For any type of respirator to function correctly, it is necessary to form a good seal between the oral-nasal unit and around the wearer's nose and/or mouth so that contaminated, or potentially contaminated ambient air cannot be inhaled. This is usually achieved by the respirator comprising an oral-nasal unit that has a peripheral edge that seals against the user's face along a line surrounding the wearer's nose and mouth. Most oral-nasal units are manufactured from a resiliently deformable material, such as a rubber-like material (e.g. silicone), to facilitate forming a seal between the unit and the wearer's face, and a great deal of effort has been invested in developing the three-dimensional shape and profile of the peripheral edge of oral-nasal units to optimise the seal and the wearer's comfort.

Most well-designed oral-nasal units comprise an inlet aperture, through which, in use, clean or filtered air passes into the interior of the unit (i.e. the sealed-off void between the interior surface of the oral-nasal unit and the wearer's face). The inlet aperture can be directly connected to a filter or air supply hose (then hence to a pressure-regulated compressed air bottle or scrubber), or in some cases, to an air supply hose leading to a remotely-located filter.

To avoid oxygen depletion or undesirable moisture build-up within the oral-nasal unit, due to re-breathing exhaled air, an exhale valve is also often provided. The exhale valve can be arranged to vent exhaled air directly to atmosphere: to atmosphere via a filter; or back to an air scrubbing system, such as that previously described, to be scrubbed and re-oxygenated.

A known problem with many types of respirator is that of "fit". Specifically, if the oral-nasal unit does not seat, and hence seal, correctly against the wearer's face, there is a risk of the wearer inhaling potentially contaminated air. However, every person has a different face shape, and thus it is difficult, if not impossible, to design an oral-nasal unit that will fit 100% of a given population. On the other hand, it is uneconomic, and generally undesirable from an inventory point of view, to manufacture and store oral-nasal units in a range of configurations (to fit different face shapes).

One solution is to offer wearers the choice of a full-face respirator (including a visor and a seal that seats around the periphery of the user's face) or a half-mask respirator, which comprises an oral-nasal unit only, which seals around the nose and mouth. As such, the wearer has two chances of obtaining a good fit and/or seal: either by using the oral-nasal unit, or the full-face mask option. However, if the oral-nasal unit fits a given wearer, but not the full-face mask, and if the user is required, according to prevailing PPE regulations, to wear a full-face mask, wearing a half-face mask is not permissible.

Various aspects of the invention are set forth in the appendent claims.

Suitably, the respirator provides a full-face mask and an oral-nasal unit, in combination. This configuration enables a seal to be formed, in use, between the wearer's face and the oral nasal unit and/or a peripheral seal of the full-face mask, thereby ensuring that the wearer inhales only clean air if only one or the other of the oral-nasal unit and the full-face mask forms an adequate seal against the wearer's face. This provides a double fail safe, when the respirator is used as a full face mask, and/or provides the option for the seals of the oral-nasal unit and the full-face mask to be optimised to fit the profiles of different groups of a given population.

Further, the invention provides that the respirator can be provided in kit form, whereby a wearer can opt to use the oral-nasal unit alone, as a half-face mask, or the oral-nasal unit and the full-face mask, in combination, depending on the prevailing PPE requirements and/or wearer's preferences.

The oral-nasal unit comprises a peripheral edge adapted to form, in use, a seal against the wearer's face, in use. The peripheral edge of the oral-nasal unit suitable comprises a three-dimensional profile, which is optimised to fit a given sample of a given population of wearers. The peripheral edge of the oral-nasal unit suitably comprises a resiliently deformable lip, or a plurality of spaced-apart resiliently deformable lip portions, which deform to form a seal, in use, against the wearer's face. The oral nasal unit is suitably manufactured from a single piece of resiliently deformable material, which reduces the number of possible air ingress points (by reducing the number of joints). The oral-nasal unit is suitably manufactured from a sterilisable, cleanable, durable, hypoallergenic material, such as silicone rubber.

The oral-nasal unit suitably comprises one or more fixing points for a retaining strap or harness, such that the oral-nasal unit can be worn as a half-face mask. The fixing point or points are suitably integrally formed with the oral-nasal unit, for example, by comprising integrally-formed projections. In one embodiment of the invention, a harness attachment is provided, to which one or more head adjustable straps are affixable. The harness attachment, is adapted to connect to the oral-nasal unit around the conduit. The conduit is inserted through an aperture in the harness attachment and can be retained in-situ by the bayonet-type fitting cooperating between the harness attachment and either or both of the conduit and oral-nasal unit. Additionally or alternatively, the conduit can be inserted through an aperture in the harness attachment and can be retained in-situ by a detachable filter cartridge affixed to the conduit, such that the harness attachment is sandwiched between the oral-nasal unit and the filter.

The full-face mask, where provided, suitably comprises a transparent visor portion, through which, in use, the wearer can see when wearing the mask. The visor is suitably manufactured of a tough, impact-resistant, scratch-resistant polymer. The choice of material for the visor may be dictated by other factors as well, such as resistance to chemical attach, abrasion, temperature resistance and so forth, as will be readily apparent to those concerned with PPE.

The inlet aperture is operatively connectable, in use, to a supply of breathable air. Suitably, the conduit is detachably affixable to a filter cartridge and/or to an air supply tube. A releasable locking interconnector, such as a bayonet-type fitting, is suitably provided to enable filter cartridges, air supply tubes and the like to be readily affixed to, and detached from, the conduit.

The exhale aperture suitably comprises a one-way valve to inhibit and/or prevent inhalation of contaminated air, but to permit relatively low-resistance exhalation of exhaled air.

Likewise, the inhale aperture may comprise a temporary shut-off valve, which acts to selectively close the inlet aperture when there is no filter cartridge and/or air supply tube connected thereto. Such a configuration conveniently closes-off the inlet aperture when the wearer's airway is unprotected, for example, during filter cartridge changes and the like.

The inlet aperture comprises a conduit that extends through the full-face mask. Such a configuration enables the oral-nasal unit to function as a half-face mask, even when the full-face mask is fitted as well. This is a significant departure from known full-face masks, in which the "oral-nasal unit" does not form a seal with the wearer's face, in use, thereby ensuring that all inhaled air sealingly passes through the oral-nasal unit. On the contrary, existing full-face masks comprise an oral-nasal unit that merely serves to guide the airflows of inhaled and exhaled air to prevent and/or minimise re-breathe, but do not actually form an airtight seal against the wearer's face. As such, the invention provides an oral-nasal unit that functions and performs in the same manner as a half-face mask whether or not the full-face mask is affixed thereto.

A seal is provided between the conduit and the oral-nasal unit and/or between the conduit and the full-face mask. The seal may comprise an O-ring seal surrounding the conduit in addition to a flange that clamps a portion of the resiliently deformable oral-nasal unit to a relatively solid component of the respirator.

The oral-nasal unit comprises a peripheral seal adapted to seal, in use, around the nose and mouth of a wearer's face. The inlet aperture or apertures of the oral-nasal unit communicate with a supply of breathable air, which can be provided via a filtration unit (such as a filter cartridge) or to a breathable air supply tube. In certain embodiments of the invention, the inlet apertures of the oral-nasal unit communicate with an interior volume of the full-face mask. In such a situation, the full-face mask suitably comprises a secondary inlet connectable, in use, to a supply of breathable air (for example, to the outlet of an air filter cartridge and/or to a breathable air supply tube). Provided, therefore, that the full-face mask comprises a seal that seals to the wearer's face, in use, effective separation of the inhaled and exhaled air flows can be achieved. Specifically, a wearer can inhale through the oral-nasal unit, drawing breathable air in from within the interior of the full-face mask, which breathable air enters the full-face mask via the secondary inlet aperture. The breathable air is sealingly retained within the full-face mask by the full-face mask's peripheral seal to the wearer's face. Upon exhaling, the exhaled air is vented via the outlet aperture, through the outlet conduit, to the exterior of the respirator. The seal interposed between the outlet conduit and the full-face mask therefore serves to separate the breathable air within the full-face mask from the exhaled air in the conduit, and from the potentially contaminated air outside the respirator.

The outlet conduit provides a detachable connection between the oral-nasal unit and the full-face mask, which detachable connection comprises a bayonet-type fitting. Further, the flange clamps a portion of the resiliently deformable oral-nasal unit to a relatively solid component of the respirator, thereby forming the seal.

Suitably, the respirator provides a full-face mask and an oral-nasal unit, in combination. This configuration enables a seal to be formed, in use, between the wearer's face and the oral nasal unit and/or a peripheral seal of the full-face mask, thereby ensuring that the wearer inhales only clean air if only one or the other of the oral-nasal unit and the full-face mask forms an adequate seal against the wearer's face. This can provide a double fail safe, when the respirator is used as a full face mask, and/or provides the option for the seals of the oral-nasal unit and the full-face mask to be optimised to fit the profiles of different groups of a given population.

Further, the invention provides that the respirator can be provided in kit form, whereby a wearer can opt to use the oral-nasal unit alone, as a half-face mask, or the oral-nasal unit and the full-face mask, in combination, depending on the prevailing PPE requirements and/or wearer's preferences.

The oral-nasal unit comprises a peripheral edge adapted to form, in use, a seal against the wearer's face, in use. The peripheral edge of the oral-nasal unit suitably comprises a three-dimensional profile, which is optimised to fit a given sample of a given population of wearers. The peripheral edge of the oral-nasal unit suitably comprises a resiliently deformable lip, or a plurality of spaced-apart resiliently deformable lip portions, which deform to form a seal, in use, against the wearer's face. The oral nasal unit is suitably manufactured from a single piece of resiliently deformable material, which reduces the number of possible air ingress points (by reducing the number of joints). The oral-nasal unit is suitably manufactured from a sterilisable, cleanable, durable, hypoallergenic material, such as silicone rubber.

The oral-nasal unit suitably comprises one or more fixing points for a retaining strap or harness, such that the oral-nasal unit can be worn as a half-face mask. The fixing point or points are suitably integrally formed with the oral-nasal unit, for example, by comprising integrally-formed projections. In one embodiment of the invention, a harness attachment is provided, to which one or more head adjustable straps are affixable. The harness attachment, in a preferred embodiment, is adapted to connect to the oral-nasal unit around the conduit. The conduit is inserted through an aperture in the harness attachment and is retained in-situ by the bayonet-type fitting cooperating between the harness attachment and either or both of the conduit and oral-nasal unit. The conduit is inserted through an aperture in the harness attachment and can be retained in-situ by a detachable filter cartridge affixed to the conduit, such that the harness attachment is sandwiched between the oral-nasal unit and the filter.

The full-face mask suitably comprises a transparent visor portion, through which, in use, the wearer can see when wearing the mask. The visor is suitably manufactured of a tough, impact-resistant, scratch-resistant polymer. The choice of material for the visor may be dictated by other factors as well, such as resistance to chemical attach, abrasion, temperature resistance and so forth, as will be readily apparent to those concerned with PPE.

The inlet aperture is operatively connectable, in use, to a supply of breathable air. Suitably, the conduit is detachably affixable to a filter cartridge and/or to an air supply tube. A bayonet-type fitting is provided to enable filter cartridges, air supply tubes and the like to be readily affixed to, and detached from, the conduit.

The exhale aperture suitably comprises a one-way valve to inhibit and/or prevent inhalation of contaminated air, but to permit relatively low-resistance exhalation of exhaled air.

Likewise, the inhale aperture may comprise a temporary shut-off valve, which acts to selectively close the inlet aperture when there is no filter cartridge and/or air supply tube connected thereto. Such a configuration conveniently closes-off the inlet aperture when the wearer's airway is unprotected, for example, during filter cartridge changes and the like.

The inlet aperture comprises a conduit that extends through the full-face mask. Such a configuration enables the oral-nasal unit to function as a half-face mask, even when the full-face mask is fitted as well. This is a significant departure from known full-face masks, in which the "oral-nasal unit" does not form a seal with the wearer's face, in use, thereby ensuring that all inhaled air sealingly passes through the oral-nasal unit. On the contrary, existing full-face masks comprise an oral-nasal unit that merely serves to guide the airflows of inhaled and exhaled air to prevent and/or minimise re-breathe, but do not actually form an airtight seal against the wearer's face. As such, the invention provides an oral-nasal unit that functions and performs in the same manner as a half-face mask whether or not the full-face mask is affixed thereto.

A further problem that exists with known respirators is that of in-use filter changes. In highly contaminated, and damp environments in particular, respirator filters can clog-up or become difficult to breathe through. Excessive respiratory strain can be tiring, and can be harmful over prolonged periods, and in situations where the wearer's concentration is paramount (e.g. in the case of fire-fighters, soldiers and the like), it is desirable to change the filter as soon as possible following an air transduction drop or filter failure. However, if the wearer is located in a contaminated environment when this occurs, the filter must be changed whilst the respirator is in-situ (i.e. on the wearer' face). In-situ filter changes can be difficult because the filter is generally out of sight of the wearer (i.e. adjacent a wearer's cheek and/or out of direct eyesight). Since it is not always possible or practical to get another person to change the filter, a wearer needs to be able to remove and correctly replace the filter without sight of what he or she is doing. With bayonet-type filter connectors, in particular, it can be difficult to correctly align, engage and seat a replacement filter, and any time spent with a filter removed presents a finite risk of contamination ingress.

The bayonet-type connector may comprise a male part and a female part, the male part comprising a tube having at least two radially-extending lugs formed on its outer sidewall adapted to engage with first and second engaging ribs located on an interior sidewall of the female part, characterised by the radially-extending lugs and the engaging ribs being located at different axial positions.

The bayonet connector may comprise a male part and a female part, the female part comprising a tube having at least two inwardly radially-extending lugs formed on its inner sidewall adapted to engage with first and second engaging ribs located on an exterior sidewall of the male part, characterised by the radially-extending lugs and the engaging ribs being located at different axial positions.

Suitably, by appropriately configuring the locations and dimensions of the ribs and lugs, the bayonet connector can provide an "any on, single lock position" connector, which is suitable for affixing a filter cartridge, say, to a respirator. As such, this provides that a filter cartridge comprising a corresponding connector can be offered up to a respirator comprising the connector in any position and rotated about the axis of the connector to lock it. However, the bayonet connector suitably locks at a single position, thereby ensuring that the filter cartridge is correctly aligned with respect to the respirator.

In other words, the bayonet connector can ensure, in certain embodiments, that the filter cartridge always lines-up with a pre-set orientation when locked in-situ, regardless of the angle of first placement. This has major benefits inasmuch as the wearer can more easily affix a filter cartridge when wearing the mask (which can be very difficult with existing bayonet designs); the field of view is less likely to be obscured by an incorrectly-fitted filter; and the overall appearance and performance of the respirator can be preserved by ensuring that the alignment of the filter is always as designed.

The corresponding sets of lugs and ribs are axially offset relative to one another such that during insertion of the male part into the female part, or vice-versa, a first one of lugs is configured to pass-by the rib corresponding to the other one of the lugs, and then to pass behind the rib corresponding to the first lug. Suitably, at least one of the ribs comprises an end-stop, such as a ridge or abutment surface, that prevents relative rotation of the male and female parts beyond a locking position. Thus, the male and female parts can be locked together by inserting the male part into the female part and by relatively rotating them until one of the lugs engages an end stop of its corresponding rib.

Each rib extends around the male or female part through an internal angle A, thus leaving a clearance angle B equal to 360 degrees minus A. If the lugs extend around the male or female part through an angle C of less than B, the two parts can be offered up to one through a range of orientations equal to B minus C. In known bayonet fittings, where the lugs are not axially-offset, the offering-up angle is half of B minus C, and so the bayonet connector provides a greatly increased range of offering-up orientations. Moreover, where the lugs are not axially-offset, it may be possible to incorrectly align the connection, for example, with the two components being relatively rotated through 180 degrees, 120 degrees, 90 degrees, etc. where each component comprises two, three or four lugs, respectively. Because the lugs are axially-offset, there is only one locking position, and so the two components can only be locked together at a single, desired relative orientation.

Embodiments of the invention shall now be described, by way of example only, with reference to the accompanying drawings in which.

Figure 1:
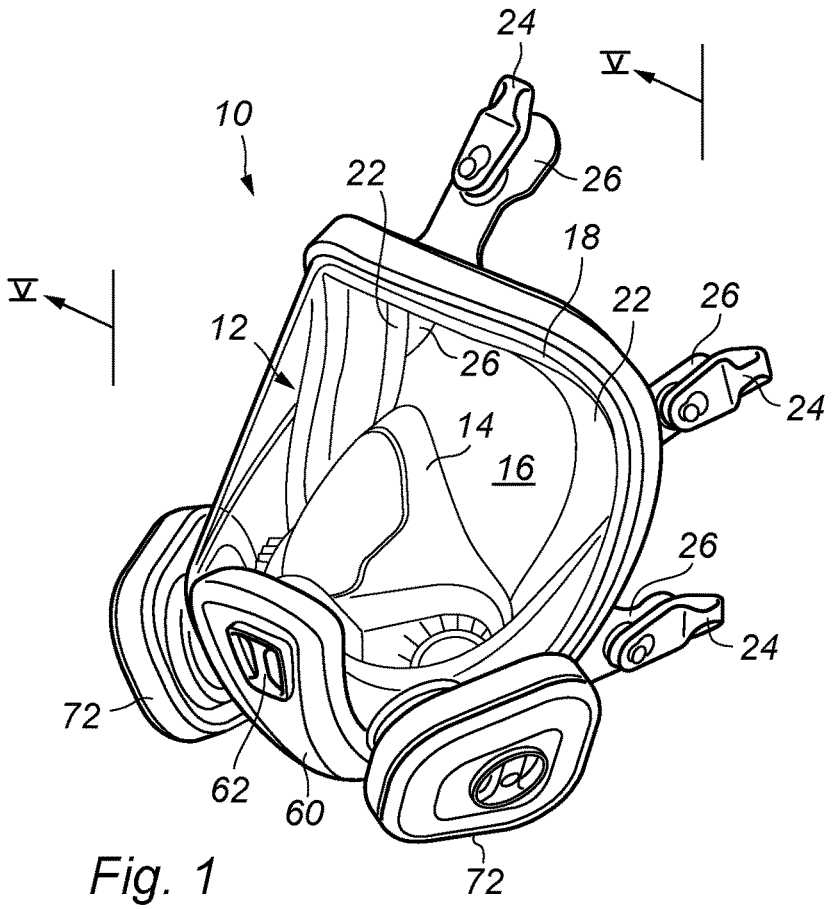
FIG. 1 is a perspective view of a full-face respirator in accordance with the invention.

In FIG. 1, a full-face respirator 10 comprises a full-face mask 12 and oral-nasal unit 14 that are connected to one another to form a unit. The full face mask 12 comprises a transparent visor 16 manufactured from a tough, durable, optically clear polymer, such as ABS through which a wearer can see when wearing the respirator 10. The visor 16 provides protection to the wearer's face and eyes, and serves as an integral part of the respirator 10.

The visor 16 comprises a profiled lip 18 to which a silicone rubber face seal 20 is sealingly affixed, for example, via a mechanical and/or adhesive connection (not visible). The face seal 20 has a three-dimensional profile that has been optimised to form an effective seal against the faces of a designated population of people, and it will be appreciated that different visor-seal combinations could be used to fit different groups of a given population of people.

The face seal 20 has an inwardly turned lip portion 22, which allows the seal 20 to flex to seat correctly against the face of a wearer, thus forming an effective airtight seal.

The respirator 10 is affixed to the wearer's head (not shown) in use, by a head harness (not shown), which connects to the respirator 10 via a set of adjustable straps (not shown) that connect to five, in the illustrated embodiment, strap buckles 24. The strap buckles 24 detachably affix, in the illustrated embodiment, to a corresponding set of tabs 26, which project rearward from the visor 16.

Figure 2:
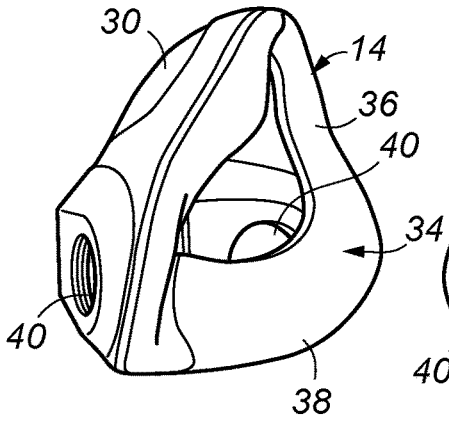
FIGS. 2 and 3 are perspective views of the oral-nasal unit of the respirators described herein.
Figure 3:
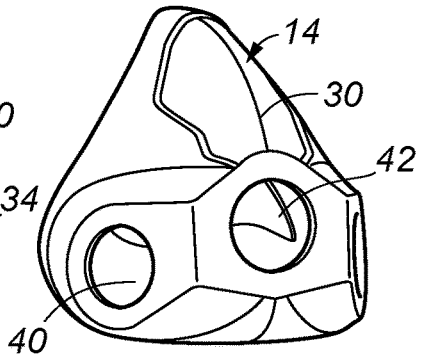

The oral-nasal unit 14 is manufactured from a unitary silicone rubber moulding, and can be seen more clearly in FIGS. 2 and 3 of the drawings. The oral-nasal unit 14 comprises a hollow main body portion 30 having a generally tetrahedral shape with an open face 32 into which a wearer's mouth and nose are placed, in use. The open face 32 is surrounded by an integrally formed, inwardly turned-over peripheral lip 34 whose three-dimensional profile is optimised to fit a particular group of a given population. The lip 34 comprises side portions 36 that are deformable in use to conform to the shape of a wearer's cheeks, and a lower portion 38 that is deformable in use to conform to the shape of a wearer's chin and lower lip, thereby forming an airtight seal when pressed against the wearer's face. When correctly worn, the oral-nasal unit 14 forms a hollow interior volume between the wearer's face and the interior walls of the oral-nasal unit 14, which can be sealed-off from the interior of the full-face mask 12 or the surrounding atmosphere, as shall be described below.

The oral-nasal unit comprises a pair of circular inlet apertures 40 through which inspired air enters the hollow interior volume, and a circular exhale aperture 42 through which exhaled air passes, in use.

Figure 4:
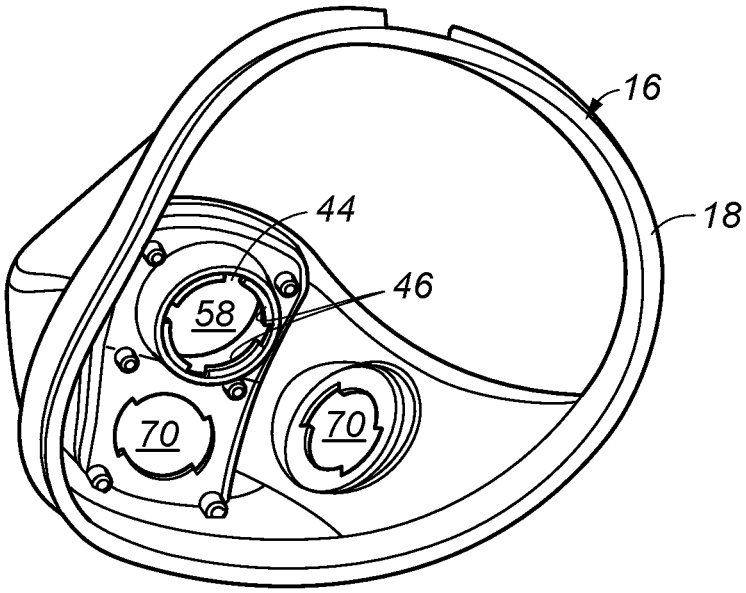
FIG. 4 is a perspective view of the interior of the visor of FIG. 1.
Figure 5:
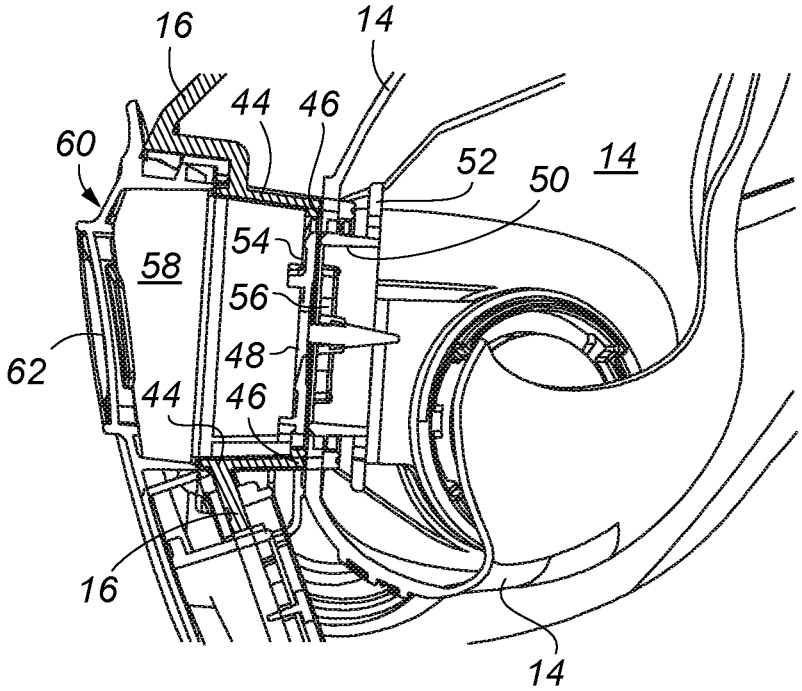
FIG. 5 is a partial cross-section of FIG. 1 on V-V.

Turning now to FIGS. 4 and 5, the oral-nasal unit 14 is located within the full-face mask 12 and is connected thereto by a conduit portion 44 integrally formed with the visor 16. The conduit portion 44 comprises a frusto-conical tube having a bayonet-type fitting 46 at its inward end that engages with an exhale valve assembly 48. The exhale valve assembly 48 is also tubular and comprises a main body portion 50 that extends through the exhale aperture 42 of the oral-nasal unit 14 and into the open end of the conduit portion 44 of the visor 16. The exhale valve assembly 48 comprises a flange 52 that seats against an inner surface of the oral-nasal unit 12 such that when it is connected to the visor 16, the oral-nasal unit 14 is clamped between the flange 52 of the exhale valve assembly 48 and an inwardly-turned lip forming part of the bayonet-type fitting 46 of the conduit portion 44, to form an airtight seal.

The exhale valve assembly 48 additionally comprises a flap valve diaphragm 54 that is retained by a retaining boss 56 that permits the diaphragm 54 to flex to allow exhaled air out of the respirator 10, but to prevent its inward flow.

The outlet of the exhale valve assembly 48 communicates with an intermediate chamber 58 formed by the outer end of the conduit portion and an external cover plate 60, which clips to the front of the respirator 10, as can be seen in FIG. 1, which has a secondary outlet aperture 62 therein in fluid communication with the surrounding atmosphere. A secondary exhale filter (not shown) can be provided in the chamber 58, if desired, to filter exhaled air.

When a wearer inhales, air is drawn into the interior of the oral-nasal unit 14 via the inlet apertures 40, which (in the full-face respirator 10 embodiment shown in FIGS. 1 and 6), communicate with the interior of the full-face mask 12. Thus, the oral-nasal unit 14 provides complete separation between the inhaled and exhaled air flows, thus preventing re-breathe, fogging of the visor 16 and undesirable moisture build-up within the respirator 10.

The visor 16 additionally comprises three inhale apertures 70, each having a bayonet-type fitting to which a filter cartridge 72 can be affixed. One, two or three of the inhale apertures 70 can be used, depending on user requirements, however, in the illustrated embodiment, two filter cartridges 72 are used.

Figure 6:
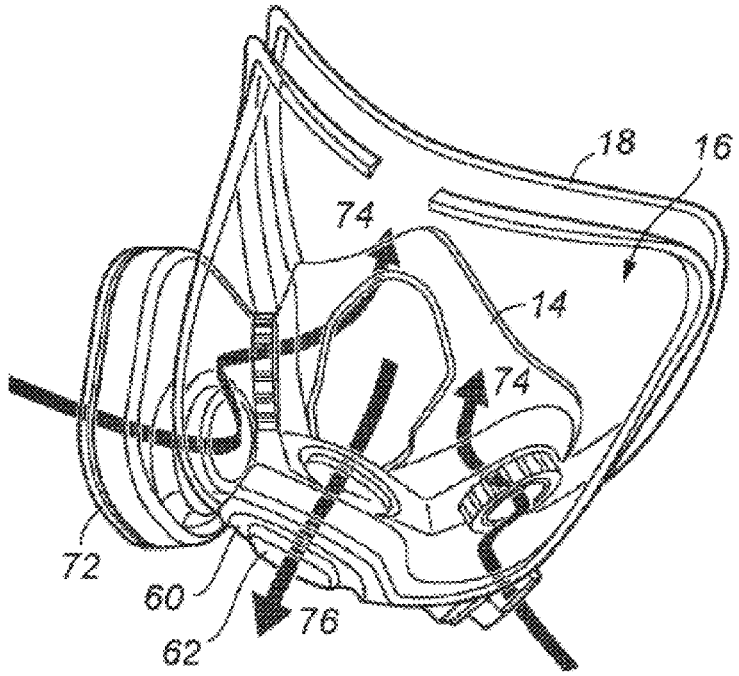
FIG. 6 is a perspective view from above of the respirator of FIG. 1 with one filter cartridge removed.

As can be seen most clearly from FIG. 6, air enters the respirator 10 via the filters, as shown by arrows 74, and exits via the exhale valve, as shown by arrow 76. Although not shown in the illustrated embodiments, a connector conduit manufactured from a length of flexible tubing could be inserted between the inlet aperture 70 of the visor 16 and the corresponding inlet aperture 40 of the oral-nasal unit 14. Such a configuration would provide a double failsafe as there would be an effective seal between the users face and the visor, as well as a secondary seal between the oral-nasal unit and surrounding the user's nose and mouth. By making the connector conduit (not shown) from a flexible material, such as silicone rubber, it is possible to offer the oral-nasal unit 14 up to the visor and to connect its outlet aperture 42 to the exhale valve assembly of the visor and to rotate it into engagement therewith via the bayonet connector previously described. The connector conduit or conduits (not shown) could then be folded and bent into engagement with respective spigots (not shown) of the inlet aperture 70 of the visor 16 and the corresponding inlet aperture 40 of the oral-nasal unit 14, thereby forming a sealed passageway between the two for the passage of inhaled air. Suitably, the connector conduit comprises a resiliently deformable seal at either end thereof, which seals form an airtight seal between the inlet aperture 70 of the visor 16 and the corresponding inlet aperture 40 of the oral-nasal unit 14, respectively.

A half-face respirator 100 is shown in FIGS. 7A, 7B, 8, 9, and 10J of the drawings, which comprises the same oral-nasal unit 14 as that described above. In this embodiment, however, there is no full-face mask 12, and so the oral-nasal unit 14 functions as the major air isolating component of the respirator 100. Nevertheless, most of the description that follows is applicable also to the full-face respirator 10 described previously.

Figure 7A:
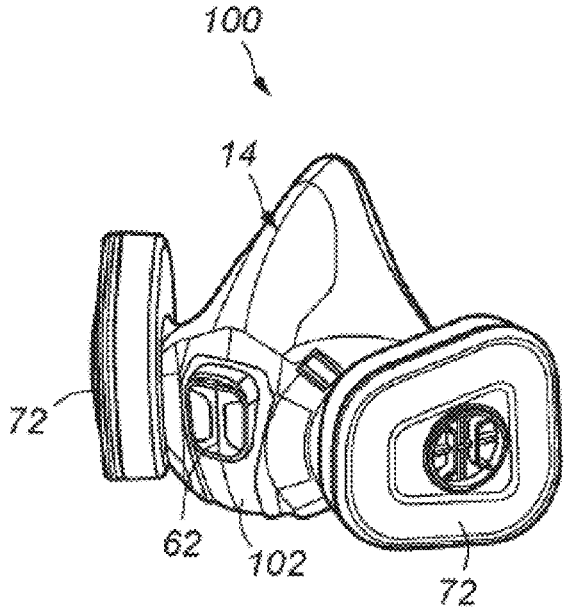
FIGS. 7A and 7B are perspective views of the oral-nasal unit and head harness of a half-face respirator, respectively.
Figure 7B:
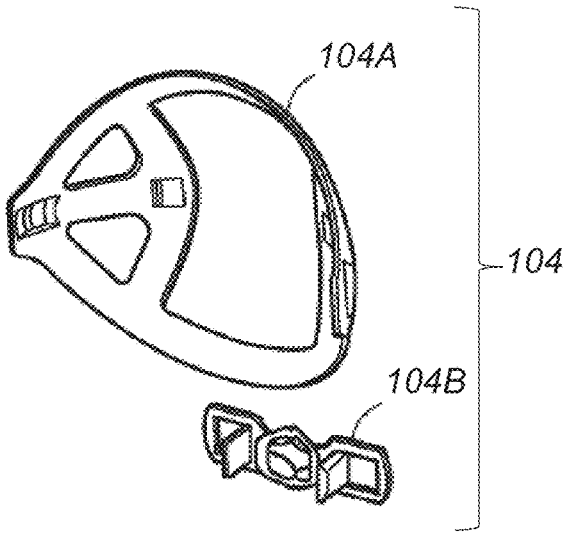
Figure 10A:
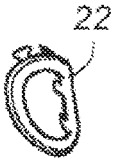
FIGS. 10A-10H and FIGS. 10K-10Q are schematic views showing the various components of a full-face respirator (FIG. 10I) and a half-face respirator (FIG. 10J), respectively in accordance with the invention.
Figure 10B:
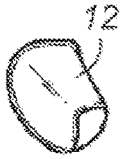
Figure 10C:
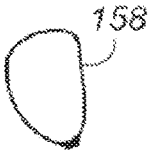
Figure 10D:
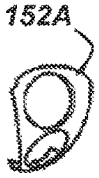
Figure 10E:
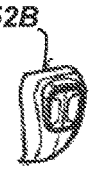
Figure 10F:
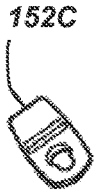
Figure 10G:
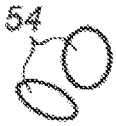
Figure 10H:
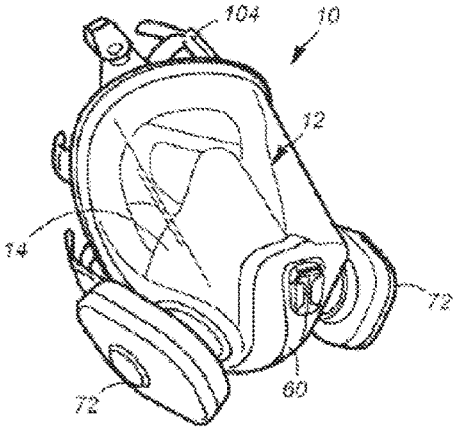
Figure 10I:
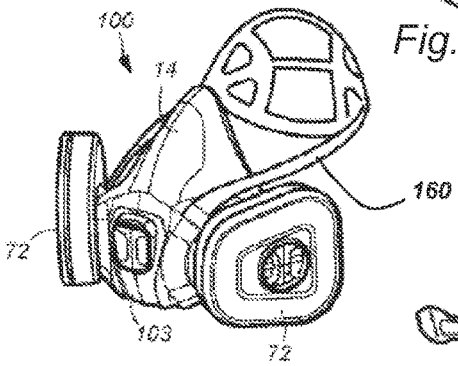
Figure 10O:
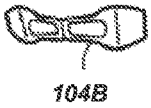
Figure 10J:
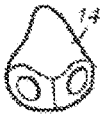
Figure 10K:
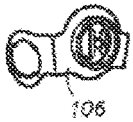
Figure 10L:
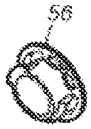
Figure 10M:
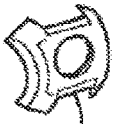
Figure 10N:
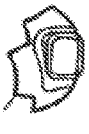
Figure 10P:
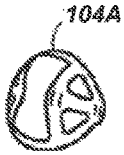

In FIGS. 7A and 7B, the half-face respirator 100 comprises an oral-nasal unit 14 connected to a harness assembly 102 to which a head harness (104A and B) is connected via adjustable, elasticated straps 160 (shown in FIG. 10J). The respirator 100 comprises a pair of filter cartridges 72 that connect to the inlet apertures 40 of the oral-nasal unit 14, through which the wearer inhales, in use. Exhaled air leaves the oral-nasal unit 14 via the exhale aperture 42, into an intermediate chamber 58 of the harness assembly 102 and out through a secondary outlet aperture 62 of the harness assembly 102.

Figure 8:
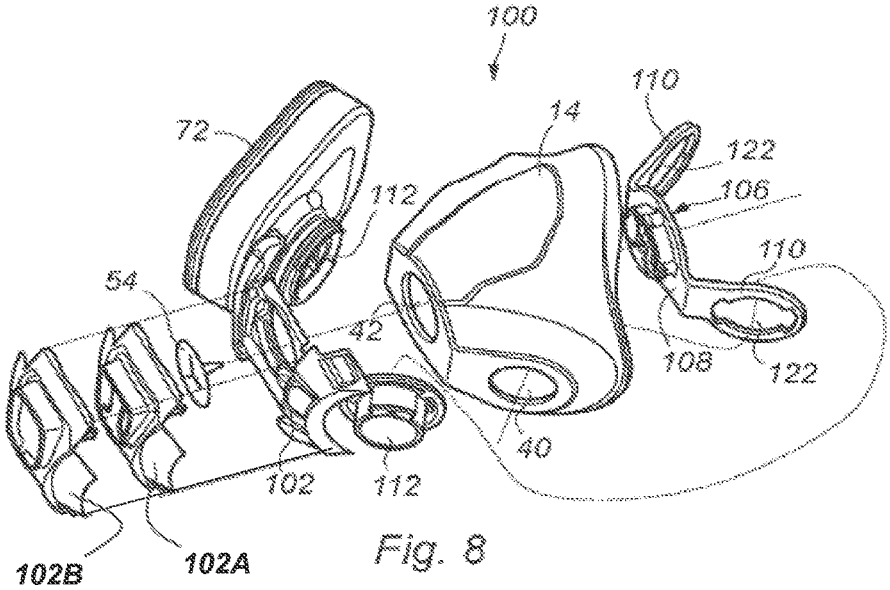
FIG. 8 is an exploded view of the oral-nasal unit of the half-face respirator of FIG. 7A.

As can be seen from FIG. 8, the half-face respirator 100 is formed of a number of interlocking components, which facilitates breaking-down, cleaning, maintaining and replacing various components thereof during the life of the respirator 100.

The oral-nasal unit 14 is connected to the harness assembly 102 by a relatively rigid, generally U-shaped plate 106 (when viewed from above), which seats against the correspondingly shaped surfaces of the interior of the oral-nasal unit 14. The plate 106 comprises a central portion 108 having a tubular extension 50 that forms part of the exhale valve assembly 54, and which extends through the exhale aperture 42 of the oral-nasal unit 14, as previously described. The oral-nasal unit 14 is thus sealingly clamped to the harness assembly 102 by connecting the tubular extension 50 to the harness assembly 102, i.e. by insertion and rotation.

Figures 9, 9A, 9B, 9C, 9D:
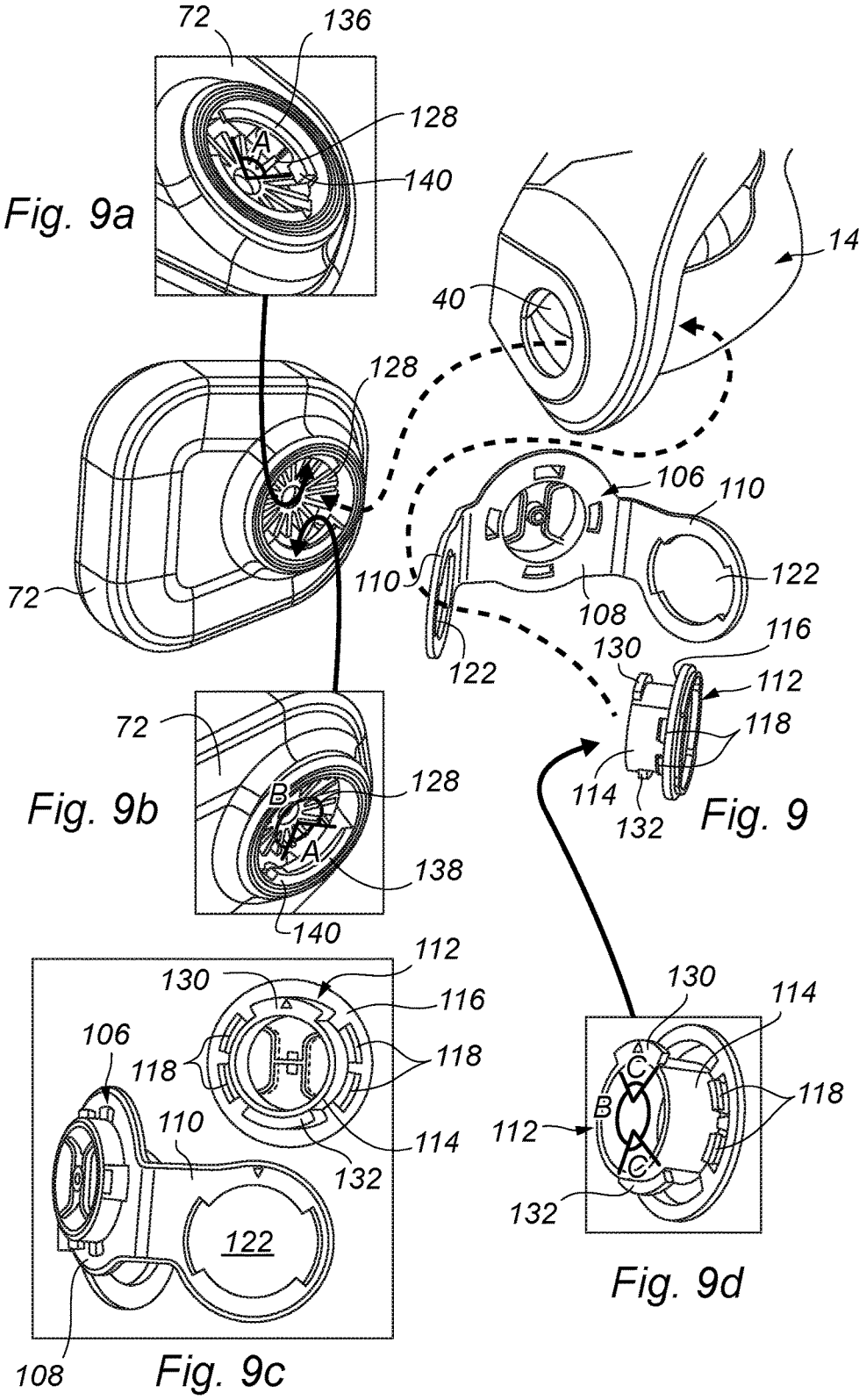
FIG. 9 is an exploded view of the respirators described herein, showing a bayonet connection for affixing a filter cartridge to a respirator.

The U-shaped plate 106 additionally comprises integrally formed wing portions 110 each comprising a through aperture to which a filter connection bayonet tube 112 clips from the inside of the oral-nasal unit 14, as shown more clearly in FIG. 9.

The bayonet tube 112 comprises a main body portion 114 and a flange 116 that seats against the exterior surface of the wing portion 108 of the U-shaped plate 106. As can be seen in inset 9*c* of FIG. 9, the flange 116 comprises a set of four clips 118, that clip into a correspondingly-shaped cut-out in the through aperture 122 of the side wing 110. The main body portion 114 extends through the aperture 122 and through the inlet aperture 40 of the oral-nasal unit 14, as shown by dashed line 124 in FIG. 9. The free end 126 of the main body portion 114 projects beyond the inlet aperture 40 of the oral-nasal unit 40 enabling the outlet 128 of the filter cartridge 72 to connect thereto via a bayonet-type connection.

Referring to inset 9*d* of FIG. 9, the main body portion 114 of the bayonet tube 112 comprises a pair of diametrically opposes lugs 130, 132 at axially offset positions on the main body portion 114. The lugs 130, 132 extend around the exterior surface of the main body portion 114 through an angle C. The lugs 130, 132 are adapted to engage with corresponding ribs 136, 138 of the outlet 128 of the filter cartridge 72.

Referring now to insets 9*a* and 9*b* of FIG. 9, the outlet 128 of the filter cartridge comprises a pair of inwardly-projecting ribs 136, 138 that are axially offset by a distance corresponding to the axial offset of the lugs 130, 132. Each rib 136, 138 has an integrally-formed end stop 14 in the form of an axial abutment that prevents the lugs 130, 132 from sliding past a certain position. The ribs 136, 138 extend around the interior surface of the filter cartridge's outlet 128 through an angle A, leaving the remaining angle B as a clearance for the lugs 130, 132.

The filter cartridge 72 can thus be offered up to the bayonet tube 112 at any angle whereby the first lug 130 lies within the clearance angle B of the first rib 138. Because the second lug 132 is axially offset relative to the first 130, the second lug 132 does not need to clear the first rib 138. The filter cartridge 72 can thus be pushed home and rotated. If the lugs 130, 132 engage the outer surfaces of the ribs 136, 138, the filter cartridge can be rotated until a clearance is located whereupon it will push into position. Further rotation of the filter cartridge 72 results in the lugs 130, 132 sliding over the ribs 136, 138 until they locate behind their respective ribs 136, 138 until, eventually, the lugs 130, 132 abut the end stops 140 indicating that the filter cartridge 72 has been correctly attached. If, say, the filter cartridge 72 is offered-up at an incorrect angle, because the lugs 130, 132 and ribs 136, 138 are axially offset, there is only one locking position, and so the filter cartridge 72 cannot be affixed incorrectly.

The lugs 130, 132 and/or the ribs 136, 138 comprise an inclined surface and/or a detent, which respectively serve to clamp the flange 116, and hence the wings 110 into sealing engagement with the oral-nasal unit 14; and to provide a positive "click" to indicate correct alignment and to inhibit disconnection of the filter-cartridge 72.

Finally, FIG. 10 shows a kit of parts in accordance with the invention, for forming a full-face respirator 10 or a half-face respirator 100 from a common set of components, which are suitably provided in a single package or kit 200.

The kit comprises a common set of components, namely the oral-nasal unit 14 and the exhale valve components 106, 54, 56. A range of oral-nasal units 14 may be provided, for example, in different sizes and shapes and/or manufactured from different materials, such that each wearer can be individually fitted with a suitable oral-nasal unit appropriate to their face geometry. A set of components, including the visor 12 (which can also be provided in different sizes and shapes to fit different user's face geometries), face seal 22, face seal retaining clip 150 and the front cover components 152 can be attached to the common components to form the full-face respirator 10. A set of components, including the harness assembly components 102 can be added to the common components to form the half-face respirator 100. Further, consumable components, such as filter cartridges of various specifications can be included in the kit, or supplied separately.

By providing a range of oral-nasal units and visors/face seals, each user can have an oral-nasal unit and visor correctly fitted. The ability to mix and match different oral-nasal units and visors/face seals in a single system represents a significant step forward in the design and provision of respirators because it affords much greater flexibility in designing and fitting respirators. As such, each user can be issued with an individual "PPE kit" comprising an individually-fitted oral-nasal unit that can be worn as a half-mask respirator, and an individually-fitted visor/face seal that enables the half-mask respirator to be converted into a full-face respirator as and when required.

The invention is not restricted to the details of the foregoing embodiments, which are merely exemplary of the invention. For example, the shape and configuration of various components, their dimensions and materials of manufacture may be changed without departing from the invention. Moreover, the respirator may be provided as a half-mask respirator, a full-face respirator, or a kit that can form either or both. The bayonet-type connection for the filter cartridges may be omitted in certain embodiments of the respirator, and/or the bayonet-type connector may be used in other applications.

The respirator is suitably a PPE device, which may be adapted for various applications, such as chemical handling, spray painting applications, fire-fighting activities, construction work (including woodworking and glass-fibre work) and so forth, but this is not an exhaustive list.

The invention claimed is:

1. A respirator comprising:

an oral-nasal unit comprising a first peripheral seal adapted, in use, to form a first seal around a nose and mouth of a wearer's face and having an inlet aperture in fluid communication, in use, with a supply of breathable air, and an outlet aperture;

a relatively rigid insert comprising: an exterior profile adapted to seat against a correspondingly shaped interior surface of the oral-nasal unit; an outlet conduit comprising a tube adapted to extend through the outlet aperture of the oral-nasal unit; and a wing portion comprising a through aperture registering with the inlet aperture of the oral-nasal unit, wherein the outlet conduit of the relatively rigid insert includes an exhale valve assembly, wherein the respirator is configured to selectively interchange for use between a full-face configuration and a half-face configuration, wherein, in only the half-face configuration, a harness assembly, having at least one strap for coupling the oral-nasal unit to a wearer's head, is coupled to the oral-nasal unit, wherein, in the half-face and full-face configurations, the first peripheral seal is configured to form the first seal between the oral-nasal unit and the wearer's face, wherein, in only the full-face configuration, a full-face mask is coupled to a front surface of the oral-nasal unit and a second peripheral seal is configured to form a second seal at least partially around a perimeter of a user's face between the full-face mask and the wearer's face wherein the full-face mask includes a bayonet connector formed as a part of an integral conduit, the bayonet connector configured to engage the exhale valve assembly.

2. The respirator of claim 1, wherein the inlet aperture of the oral-nasal unit communicates with the supply of breathable air provided via any one or more of the group consisting of: a filtration unit; a filter cartridge; bottled air; and a breathable air supply tube.

3. The respirator of claim 2, wherein the full-face mask comprises a secondary inlet connectable, in use, to the supply of breathable air.

4. The respirator of claim 2, wherein the inlet aperture of the oral-nasal unit communicates with an interior volume of the full-face mask.

5. The respirator of claim 1, wherein the inlet aperture of the oral-nasal unit communicates with an interior volume of the full-face mask.

6. The respirator of claim 1, wherein the first peripheral seal and the second peripheral seal each comprise a three-dimensional profile and at least one resiliently deformable lip, which deforms, in use, to form respective ones of the first and second seal.

7. The respirator of claim 1, wherein the oral-nasal unit comprises a unitary molding manufactured from a resiliently deformable material.

8. The respirator of claim 1, wherein the oral-nasal unit comprises one or more fixing points to which, in use, a retaining strap or harness is detachably affixable.

9. The respirator of claim 1, wherein the oral-nasal unit comprises a harness attachment having an aperture for receiving the outlet conduit.

10. The respirator of claim 1, further comprising the full-face mask, wherein the full-face mask comprises a transparent visor portion.

11. The respirator of claim 1, wherein the outlet aperture comprises a one-way valve.

12. The respirator of claim 1, wherein the inlet aperture comprises a temporary shut-off valve adapted to selectively close the inlet aperture when there is no filter cartridge and/or air supply tube connected thereto.

13. The respirator of claim 12, wherein the full-face mask comprises a secondary inlet connectable, in use, to the supply of breathable air.

14. The respirator of claim 1 further comprising:

a bayonet connector formed as part of an integral conduit, the bayonet connector configured to engage the exhale valve assembly.

15. The respirator of claim 14, wherein the bayonet connector is connectable, in use, from inside the relatively rigid insert and extending through the inlet aperture of the oral-nasal unit to which, in use, a filter cartridge and/or air supply tube is detachably affixable.

16. A respirator assembly comprising:

an oral-nasal unit comprising:

a first peripheral seal;

a first inlet aperture disposed on a first side of the oral-nasal unit;

a second inlet aperture disposed on a second side of the oral-nasal unit; and an outlet aperture, wherein each of the first inlet aperture and the second inlet aperture are in fluid communication with a supply of breathable air, a full-face mask comprising a transparent visor and a second peripheral seal extending around the periphery of the transparent visor;

a harness assembly having at least one strap for coupling the oral-nasal unit to a wearer's head;

a first filter coupled to the first inlet aperture; and a second filter coupled to the second inlet aperture, wherein the respirator is selectively interchangeable for use between a full-face configuration and a half-face configuration, wherein, in the half-face and full-face configurations, the first peripheral seal is configured to form a first seal between the oral-nasal unit and a wearer's face, and wherein, in only the full-face configuration, the full-face mask is coupled to a front of the oral-nasal unit and the second peripheral seal is configured to form a second seal between the full-face mask and the wearer's face.

* * * * *